US005769056A

United States Patent [19]

Geiger et al.

[11] Patent Number: 5,769,056

[45] Date of Patent: Jun. 23, 1998

[54] FUEL INJECTION PUMP

[75] Inventors: Wolfgang Geiger, Remshalden; Thomas Kulder, Steinheim, both of Germany

[73] Assignee: Robert Bosch GmbH, Stuttgart, Germany

[21] Appl. No.: 836,319

[22] PCT Filed: Apr. 17, 1996

[86] PCT No.: PCT/DE96/00674

§ 371 Date: May 12, 1997

§ 102(e) Date: May 12, 1997

[87] PCT Pub. No.: WO97/10430

PCT Pub. Date: Mar. 20, 1997

[30] Foreign Application Priority Data

Sep. 13, 1995 [DE] Germany ..... 195 33 807.3

[51] Int. Cl.[6] ..... F02M 37/04

[52] U.S. Cl. ..... 123/502; 123/450

[58] Field of Search ..... 123/502, 449, 123/500, 501, 450; 417/462

[56] References Cited

U.S. PATENT DOCUMENTS

| | | | |
|---|---|---|---|
| 4,476,837 | 10/1984 | Salzgeber | 123/502 |
| 4,798,189 | 1/1989 | Thornwaite | 123/502 |
| 4,920,940 | 5/1990 | Harris | 123/450 |
| 5,123,393 | 6/1992 | Djordjevic | 123/450 |
| 5,125,802 | 6/1992 | Nakamura | 123/502 |
| 5,263,457 | 11/1993 | Konrath | 123/502 |
| 5,647,327 | 7/1997 | Enomoto | 123/502 |

FOREIGN PATENT DOCUMENTS

| | | | |
|---|---|---|---|
| 3345841 | 6/1985 | Germany | 123/502 |

*Primary Examiner*—Carl S. Miller
*Attorney, Agent, or Firm*—Edwin E. Greigg; Ronald E. Greigg

[57] ABSTRACT

A fuel injection pump includes an injection onset adjustment piston in a cylinder bore that adjusts injection. The onset adjustment piston is embodied as a following piston which includes therein a control slide valve. The onset adjustment piston encloses a work chamber on one end, and is acted upon by the pressure in the work chamber counter to the force of a restoring spring. The onset adjustment piston is connected to an essentially stationary part of a cam drive of the fuel injection pump. In order to prevent feedback from the work chamber via the control slide valve and its adjustment, the control slide valve is effectively damped by means of a separate pin on an end of the control slide valve which extends into a blind bore of the onset adjustment piston.

1 Claim, 1 Drawing Sheet

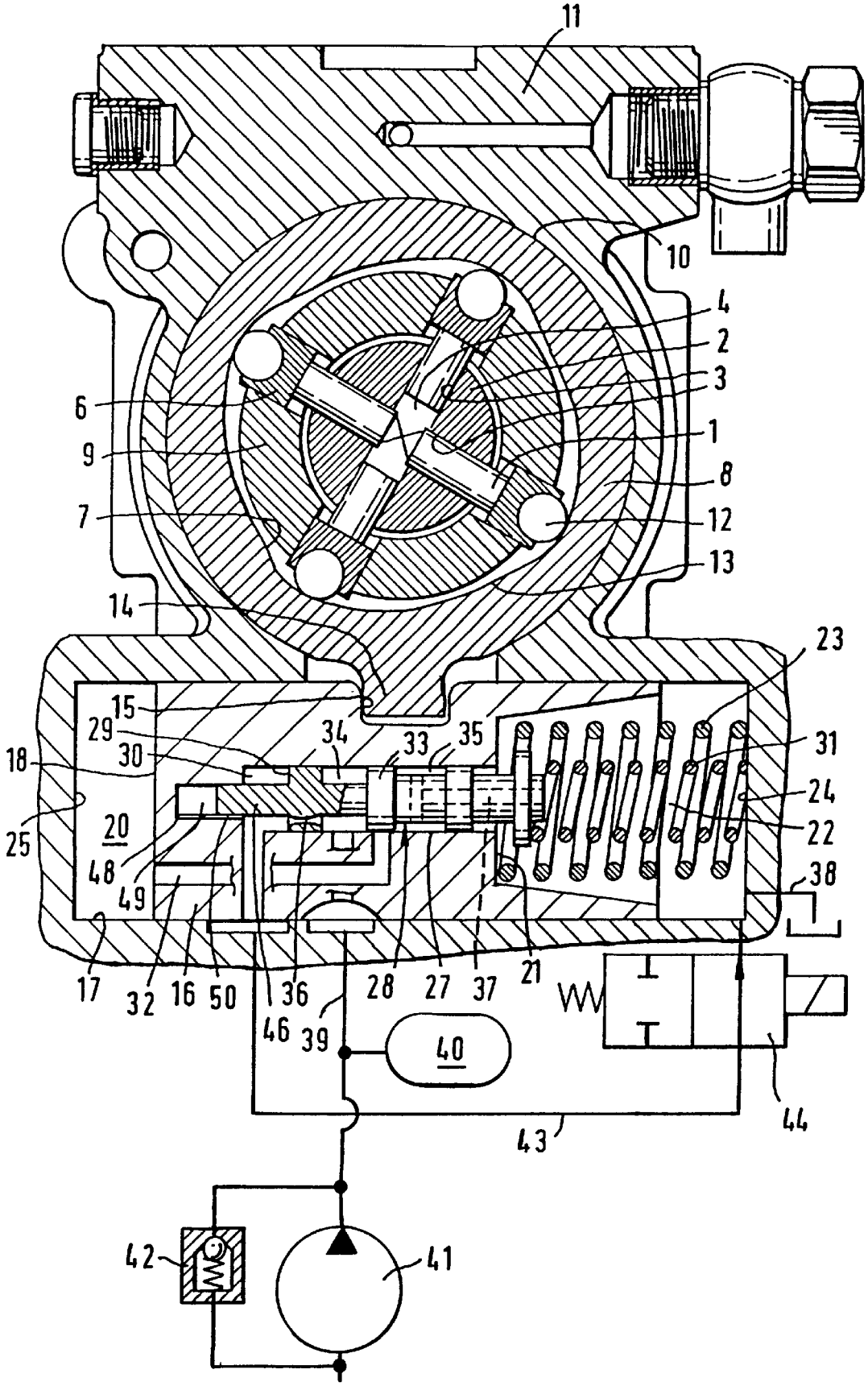
11
10
4
2
3
6
1
9
8
7
12
13
14
23
15
29
34
33
35
31
18
30
24
20
22
25
48
38
49
17
32
16
50
36
28
27
37
21
46
39
40
44
43
42
41

FUEL INJECTION PUMP

PRIOR ART

The invention is based on a fuel injection pump for a vehicle. DE 35 32 719 discloses a fuel injection pump of this kind in which the pressure fluid supply to the cylinder bore takes place via a check valve, while the pressure fluid discharge proceeds via the chamber that contains the restoring spring. The control slide valve end face which is subjected to the control pressure defines the control chamber in the cylinder bore over the entire diameter of the cylinder bore, which chamber, on the other end, communicates with a control pressure inlet via a throttle. Injection timing mechanisms of this kind are very sensitive to control pressure fluctuations and have a tendency for the control slide valve to execute oscillating movements relative to the injection timing mechanism, which leads to an unstable work behavior of the injection timing mechanism. In fact, the throttle bore has the effect that kicks back on the control pressure supply end, which are produced by the operation of the fuel injection pump, should have as little effect as possible on the control slide valve, but a balanced, average working pressure, which is effective in the control chamber, is only incompletely achieved.

ADVANTAGES OF THE INVENTION

The fuel injection pump according to the invention, has the advantage over the prior art that the control slide valve is additionally damped in its movements so that nevertheless, pressure fluctuations occurring in the control chamber do not reach through and indirectly excite the control slide valve. If the control piston is excited to oscillate by pressure surges, the fluid enclosed in the blind bore by the pin is first displaced by means of the throttle gap. The throttle action, which is produced as a result, effectively suppresses the tendency of the control piston to oscillate.

BRIEF DESCRIPTION OF THE DRAWING

An exemplary embodiment of the invention is shown in cross section in the drawing and explained in detail in the ensuing description.

DESCRIPTION OF THE EXEMPLARY EMBODIMENT

Fuel injection pumps of the distributor type can be provided either as pumps with an axially driven pump piston that is used as both a distributor and a pump piston, or radial pistons can be provided, which feed radially into a supply conduit disposed in a distributor. FIG. 1 shows a section through a so-called radial piston pump of this kind, which is of the known type. Four pump pistons 1 are provided, which are supported so they can sealingly slide in radial bores 3 of the distributor 2, at the same angular spacing in a common plane radial to the axis of the distributor 2. On their one end face, they enclose a common pump work chamber 4, which is filled with fuel via a metering device in a known manner not shown in detail here during the radial outward stroke of the pump piston 1, and during the radial inward stroke of the pump piston, communicates via a pressure line, likewise not visible here, with a distributor opening on the jacket face of the distributor 2, wherein the distributor opening controls injection lines that lead from the circumference of the distributor, one of the lines is respectively supplied with fuel that has been brought to injection pressure when the pump piston is moved inward. Through means not shown in detail, a drive shaft drives the distributor to rotate in such a way that on the one hand, the distributor opening can carry out its control function and on the other hand, the pump piston is moved in the circumference direction. Roller tappets 6 rest against the end disposed opposite the pump work chamber 4 and follow a cam track 7 which is disposed on a cam ring 8, on its annular face that points inward toward the distributor. The cam ring 8 represents essentially the stationary part of the cam drive of the pump piston. While the device that moves the pump pistons, which for example can be the ring 9 that guides the roller tappets 6, which ring is coupled to the drive shaft, represents the moving part of the cam drive. The adjustment of the cam ring, which is guided with its cylindrical outer wall in a corresponding cylindrical recess 10 of the pump housing 11 of the fuel injection pump, produces an earlier or later running of the rollers 12 of the roller tappets 6 on the respective cams 13, which are disposed so that all the roller tappets are moved synchronously inward or outward by the same strokes. As a result, the beginning of the feed stroke of the pump pistons, and thus the injection onset, changes in relation to the drive of the fuel injection pump.

For adjustment purposes, the cam ring 8 has a nose 14 that engages in a recess 15 in an injection adjustment piston 16 on its cylindrical jacket face. The injection adjustment piston can be moved sealingly in a cylinder 17 and with its one end face 18, together with the closed end of the cylinder 17, encloses a work chamber 20 and with its other end face 21 on the opposite end, encloses a spring chamber 22 in the likewise closed cylinder there. A restoring spring 23 is disposed in this chamber and is supported on one end against a wall 24 that closes the cylinder 17 and on the other end against the end face 21 of the adjusting piston 16, and is consequently clamped so that it strives to bring the injection adjustment piston 16 with its one end face 18 into contact with the wall 25 that closes the cylinder 17 on the opposite end.

An axial blind bore is also provided in the injection adjustment piston 16 as a cylinder bore 27 that guides a control slide valve 28 and opens toward the spring chamber 22. The control slide valve 28 inserted there, with one end face 29, encloses a control chamber 30 in the closed end of the cylinder bore and protrudes with its other end into the spring chamber 22, where it is acted upon by a control spring 31, whose other end is likewise supported against the wall 24. A connecting line 32 leading from the one end face 18, extends in the control piston parallel to the cylinder bore 27 and feeds radially into the cylinder bore in the region of its overlap by the control slide valve. This infeed can be closed by an annular collar 33 of the control slide valve, wherein on both ends, this annular collar defines a first annular groove 34 and a second annular groove 35 and the first annular groove 34 communicates with the control chamber 30 via a throttle 36 and the second annular groove 35 communicates with the spring chamber 22 via an axial blind bore 37 as a pressure fluid discharge, which spring chamber is in turn discharged via a relief line 38. The annular edges that define the annular collar are control edges by means of which in a relative movement of the control slide valve, the connecting line 32 is either connected to a pressure fluid inlet 39 via the first annular groove 34 or to the spring chamber 22 via the second annular groove 35. The first annular groove 34 continuously communicates with the pressure fluid inlet 39, which is supplied with pressure fluid from a pressure storage chamber 40. A fuel pump 41 with a pressure control valve 42 connected in parallel is used to supply the storage chamber, and together, they supply the pressure storage chamber in a known manner with a pressure that essentially increases in a speed dependent manner with the increasing speed of the fuel injection pump or the associated internal combustion engine. This pressure also prevails continuously in the control chamber 30 is such a way that according to the changing of this pressure, the control slide valve is slid in relation to its control spring and this is then compressed or released. The annular collar 33 carries out controlling functions in such a way that in an adjustment of the control slide valve to the right that occurs with increasing pressure, the work chamber 20 is supplied with pressure fluid until, as a result of a subsequent movement of the adjustment piston counter to the force of the spring 23, the connecting line 32, which was previously open, is closed once more. Conversely, with a reduction of the pressure in the control chamber 30, the work chamber 20 is discharged until the connecting line is closed once more. The pressure in the control chamber 30 can additionally be discharged or modified by means of a relief line 43 in which an electrically controlled valve 44 is inserted.

In the known device for adjusting the onset of injection, the problem arises that reaction forces are transmitted to the cam ring 8 via the rollers 12 when the pump pistons are driven, which forces are in turn passed on to the injection adjustment piston 16 in such a way that the pressure in the work chamber 20 is abruptly increased within in the compressibility frame of the fuel there, which is used here as pressure fluid. This pressure then is also present at the annular collar 33, via which due to leakage flows, fuel can also get into the storage chamber 30 and leads to pressure increases there, which have repercussions on the position of the control slide valve. In other types of distributor pumps that have a pump piston driven to reciprocate and simultaneously rotate, the fuel is typically supplied from the same pressure storage chamber 40 from which the control pressure for the control chamber is taken. Since in these pumps, the pressure storage chamber 40 is likewise used as a fuel supply chamber and relief chamber of the high pressure part, in particular the diversion processes at the end of the high pressure feed stroke here have a negative impact on the constancy of the control pressure. This leads respectively to an unstable behavior of the injection adjustment piston or of the entire device for adjustment of the onset of injection.

In the embodiment according to the invention, a pin 46 now protrudes on the end with the end face 29 of the control slide valve 28, which pin, from the circular end face of the control slide valve in the prior art, now constitutes an annular end face 29. The pin protrudes through the control chamber 30 and dips into a blind bore 48 that leads coaxially from the end of the cylinder bore 27 and encloses a damping chamber 49 there on its end face. The outer diameter of the pin and the inner diameter of the blind bore are embodied so that a throttle gap 50 is constituted between the wall of the blind bore and the jacket face of the pin, via which gap fuel can overflow from the damping chamber 49 into the control chamber 30 when the control slide valve or the pin 46 is slid into the blind bore 48. This produces a very significant damping of the control slide valve movement in such a way that when pressure fluctuations still occur in the control chamber 30, or when there are other forces acting on the control slide valve 28, the resulting movement is sharply braked, damped, or even prevented.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection pump having an injection adjustment piston (16) that is used to adjust an onset of injection and defines a work chamber (20) in a cylinder (17), said chamber is acted upon by a controllable pressure fluid, which forces the injection adjustment piston counter to a restoring spring (23), a control slide valve (28) is disposed so that the control slide valve can slide in a closed-ended cylinder bore (27) of the injection adjustment piston (16), in an axial direction of the injection adjustment piston (16), said control slide valve is adjusted counter to a force of a control spring (31) by a control pressure that prevails in a control chamber (30) enclosed inside the cylinder bore by the control slide valve and acts upon an end face (29) of the control slide valve, said control slide valve in the cylinder bore 27 includes control edges, said control edges control a pressure fluid inlet (39) into the cylinder bore (27), a pressure fluid outlet (37) from the cylinder bore, and a connecting line (32) from the cylinder bore (27) to the work chamber (20), wherein the pressure fluid inlet communicates via a throttle (36) with the control chamber (30) defined by the end face (29), and the end face (29) is embodied as an annular end face , which encompasses a pin (46) that protrudes from the control slide valve and extends into a blind bore (48) that adjoins the cylinder bore (27) coaxially on the inner end of the cylinder bore to form a throttle gap (50) between the wall of the blind bore and the jacket face of the pin.

* * * * *